US007117597B2

(12) United States Patent
Nishida

(10) Patent No.: US 7,117,597 B2
(45) Date of Patent: Oct. 10, 2006

(54) METHOD OF MANUFACTURING LIQUID DISCHARGE HEAD

(75) Inventor: Takehito Nishida, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/196,384

(22) Filed: Aug. 4, 2005

(65) Prior Publication Data

US 2006/0026834 A1 Feb. 9, 2006

(30) Foreign Application Priority Data

Aug. 6, 2004 (JP) ..... 2004-231533

(51) Int. Cl.
*B21D 53/76* (2006.01)
*B41J 2/05* (2006.01)

(52) U.S. Cl. ..... 29/890.1; 29/840; 29/845; 29/846; 29/848; 347/65

(58) Field of Classification Search ..... 29/890.1, 29/846, 845, 848, 840; 347/64, 63, 65, 85, 347/93, 103; 216/27, 22, 62, 100, 99
See application file for complete search history.

(56) References Cited

U.S. PATENT DOCUMENTS 4,558,333 A * 12/1985 Sugitani et al. ..... 347/65
4,873,622 A * 10/1989 Komuro et al. ..... 347/50
5,334,999 A * 8/1994 Kashiwazaki et al. ..... 347/65
5,899,390 A 5/1999 Arndt et al.
5,976,342 A 11/1999 Arndt et al.
6,059,188 A * 5/2000 diFazio et al. ..... 235/462.36
2004/0194309 A1 10/2004 Tokunaga et al.

FOREIGN PATENT DOCUMENTS

JP 03-316582 * 6/1993
JP 8-142339 6/1996
JP 10-502130 2/1998
JP 11-115182 4/1999

* cited by examiner

*Primary Examiner*—A. Dexter Tugbang
*Assistant Examiner*—Tai Van Nguyen
(74) *Attorney, Agent, or Firm*—Fitzpatrick, Cella, Harper & Scinto

(57) ABSTRACT

A method of manufacturing a liquid discharge head provided with a liquid flow path communicating with a liquid discharge port on a substrate has a step of forming a first electrically conductive layer on the substrate, a step of forming a molding member into the pattern shape of the flow path on the substrate, a step of forming a second electrically conductive layer on the molding member so as not to contact with the first electrically conductive layer, a step of forming a metal film by a plating process around the molding member by the utilization of the first electrically conductive layer and the second electrically conductive layer, and a step of removing the molding member and forming the flow path.

12 Claims, 11 Drawing Sheets

METHOD OF MANUFACTURING LIQUID DISCHARGE HEAD

BACKGROUND OF THE INVENTION

1. Field of the Invention

This invention relates to a method of manufacturing a liquid discharge head which discharges liquid by applying energy from outside to the liquid.

2. Related Background Art

A liquid discharge head which discharges desired liquid by applying energy from outside to the liquid can give the desired liquid to an object of discharge without the contact by a transfer roller or the like and therefore is used for various purposes. Above all, an ink jet recording apparatus is good in printing performance and low in cost and therefore has come to be widely utilized.

In the head of the ink jet recording apparatus, as means for discharging liquid from a discharge port formed in a liquid chamber, there are various types such as a type which generates bubbles in ink by heat energy and discharges an ink droplet by a produced pressure wave, a type which attracts and discharges an ink droplet by an electrostatic force, and a type which utilizes a pressure wave by a vibrator such as a piezoelectric element. The ink jet head includes in its construction a liquid chamber which provides a pressure generating chamber, a through port which communicates with the liquid chamber and provides a discharge port, the aforedescribed discharging means, etc.

As a method of forming a flow path structure such as the liquid chamber and the through port, mention may be made of:

(1) a method of forming the liquid chamber and the through port in a substrate by a photolithographic process and laser working;

(2) a method using plastic extrusion molding using a metal mold; and (3) a method of forming a pattern which provides a molding member for the liquid chamber and the through port, and forming resin or forming a metal by a plating process, around the molding member.

The method under item (1) above includes the step of sticking the flow path structure on other substrate on which discharging means is formed. As the sticking, mention may be made of fusion welding by the fusion by heat, pressure welding utilizing the diffusion joining by heat and load, brazing and soldering utilizing a brazing filler metal, and adhesive securing utilizing an adhesive agent. The fusion welding and the pressure welding apply heat and load and therefore, have suffered from the problem that when the device becomes high in definition and high in density, the partition wall between liquid chambers may sometimes be destroyed. Also, as regards the brazing and welding and the adhesive securing, the control of the amounts of the adhesive agent and the brazing material is very difficult, and in some cases, the leakage of the adhesive agent and the brazing material into the liquid chambers or the unsealing of the liquid chamber due to the deficiency of the adhesive agent or the brazing material has occurred.

These problems have caused a reduction in yield. Also, in the case of the adhesive agent, there has also been the problem that the pressure produced in the liquid chambers may be alleviated in some cases. Also, alignment is necessary during the welding, but there has also been the problem that this is very difficult and mass productivity lacks.

The method under item (2) above has suffered from the problem that the selection range of the plastic material is generally narrow from the condition of the mechanical characteristic thereof and the accuracy of machining and the working condition are substantially determined by the material used. Also, there has been the problem that the mechanical characteristic is low and the pressure produced in the liquid chambers is alleviated or when the produced pressure is high as in the bubble jet (BJ) type, the material may be deformed in some cases.

In the method under item (3) above, the material is low in mechanical characteristic like the plastic material, and in some cases, the alleviation of the produced pressure or the deformation by the produced pressure has occurred.

Further, as the method of forming a metal around the molding member, by the plating process the following methods can be mentioned, but each of them suffers from a problem.

In Japanese Patent Application Laid-open No. H11-115182, there is proposed a manufacturing method comprising the step of forming an integral type of nozzle and liquid chamber formed of an Ni material by electroforming, the step of forming a sacrifice layer formed of Cu in the liquid chamber, the step of forming a vibratory plate, and the step of fusing the sacrifice layer formed of Cu. In this case, it is necessary to stick the metal on a substrate on which discharging means is formed. The use of an adhesive agent during the sticking make alignment of high accuracy difficult. Also, there is a case where Cu formed as the sacrifice layer is alloyed with Ni and it becomes difficult to remove Cu only.

On the other hand, in Japanese Patent Application Laid-Open No. H08-142339 and Jae-Duk Lee, "A Thermal Inkjet Printhead with a Monolithically Fabricated Nozzle Plate and Self-Aligned Ink Feed Hole," J. Microelectromechanical Sys., Vol. 8, No. 3, September 1999, pp. 229–236, there is mentioned a method of integrally forming a nozzle plate and side walls.

In Japanese Patent Application Laid-open No. H8-142339 (see FIG. 3A of the accompanying drawings), a molding member is formed of a first fusible resin 301 and a second fusible resin 302, whereafter an electrically conductive layer is generally formed and thereafter, metal film 304 having a predetermined film thickness is formed by electroforming, and lastly the molding member is removed to thereby form a flow path structure.

Also, in Jae-Duk Lee's publication (see FIG. 3B of the accompanying drawings), a molding member formed of a fusible resin 312 is formed on a substrate on which an electrically conductive layer 311 is formed, and metal film 313 having a predetermined film thickness is formed by electroforming, and lastly the molding member is removed to thereby form a flow path structure (Jae-Duk Lee,. "A Thermal Inkjet Printhead with a Monolithically Fabricated Nozzle Plate and Self-Aligned Ink Feed Hole," J. Microelectromechanical Sys., Vol. 8, No. 3, September 1999, pp. 229–236).

The method of manufacturing a flow path structure disclosed by Japanese Patent Application Laid-Open No. H08-142339 and Jae-Duk Lee integrally forms a liquid chamber and a pattern providing a discharge port through which liquid is discharged from the liquid chamber with a fusible resin, and thereafter forms a plating layer around the pattern to thereby form a flow path structure. The liquid chamber can be formed directly on a substrate and therefore, the step of sticking is not included.

As a result, the problem due to sticking is solved, but in the case of Japanese Patent Application Laid-Open No. H08-142339, if the plating seed layer formed on the pattern is formed on the wall surface of the pattern providing the discharge port, the discharge port is closed by the plating layer and therefore, it becomes necessary to manufacture the flow path structure so that the plating seed layer may not be formed on at least the wall surface of the pattern providing the discharge port.

Methods of forming anisotropic metal film include a vapor depositing method, a sputtering method, etc., but to prevent a plating seed layer from growing on a side of a pattern, the pattern providing a discharge port need be of at least a taperless shape (the areas of the upper surface and lower surface of a molding member of a second fusible resin are equal to each other), and more preferably be of an inverted tapered shape (the area of the lower surface of the molding member of the second fusible resin is smaller than that of the upper surface thereof).

If the pattern providing a discharge port is made into an inverted tapered shape, there will arise the problem that the shape of the discharge port formed in the liquid chamber also becomes an inverted tapered shape and the deposition accuracy of the discharged liquid becomes lower than when the sticking method is used.

Also, in the case of Jae-Duk Lee's publication, the liquid chamber and the pattern providing a discharge port through which the liquid is discharged from the liquid chamber are integrally formed of a fusible resin, whereafter plating is grown from the seed layer of the plating formed on a substrate, and this leads to the problem that the corners of the cross-sectional shape of the discharge port becomes rounded and the deposition accuracy becomes lower than when the sticking method is used.

SUMMARY OF THE INVENTION.

The present invention has been made in view of the circumstances as described above and an object thereof is to manufacture a liquid discharge head without the sticking step and improve yield and enhance productivity.

A further object of the present invention is to make a nozzle of high discharge accuracy in which generated pressure is not reduced due to the deformation or the like of a liquid chamber when liquid is discharged by the manufactured head.

The present invention provides a method of manufacturing a liquid discharge head provided with a liquid flow path communicating with a liquid discharge port on a substrate, the method having a step of forming a first electrically conductive layer on the substrate, a step of forming a molding member into the pattern shape of the flow path on the substrate, a step of forming a second electrically conductive layer on the molding member so as not to contact with the first electrically conductive layer, a step of forming a metal film by a plating process around the molding member by the utilization of the first electrically conductive layer and the second electrically conductive layer, and a step of removing the molding member and forming the flow path.

The method of manufacturing a liquid discharge head according to the present invention forms on a substrate a flow path pattern comprising a first pattern providing a liquid chamber formed integrally with first electrically conductive film providing a plating seed layer and a second pattern providing a discharge port, and thereafter forms plated layer around the outer periphery of the flow path pattern with the first electrically conductive film as a seed layer, whereafter when it removes the flow path pattern to thereby form on the substrate a liquid chamber (flow path structure) having the discharge port, it forms fusible first resin film forming the first pattern providing the liquid chamber, and thereafter forms on the first resin film second electrically conductive film providing a plating seed layer, and further forms on the electrically conductive film fusible second resin film forming the second pattern providing the discharge port, and thereafter removes the second film resin leaving the first pattern covering an area of the first resin film which provides the liquid chamber. Next, it removes the second electrically conductive layer with the first pattern as a mask, and thereafter removes the second pattern of the second resin film on the electrically conductive film which provides the discharge port and the first resin film leaving the first pattern providing the liquid chamber underlying the electrically conductive film to thereby form a flow path pattern.

When electrolytic plating is effected on the outer periphery of the flow path pattern with the first electrically conductive film as a plating seed layer, a plated layer is formed on the outer periphery of the first pattern at the initial stage of the plating, and when the plated layer reaches the second electrically conductive film formed on the first pattern, a plated layer is also formed from on the second electrically conductive film.

When a metal layer by plating is to be formed on the outer periphery of the flow path pattern, it is preferable that a material resistant to plating liquid be used for at least the first electrically conductive film and the second electrically conductive film providing the plating seed layer and the first resin film and the second resin film.

Also, it is preferable that the electrically conductive layer on the first pattern be formed so as not to protrude from the pattern of the fusible resin layer forming the first pattern. Therefore, it is preferable that the area of the electrically conductive layer formed on the first pattern be equal to or smaller than the area of the upper surface of the first pattern.

The plated layer formed on the first pattern is not formed on the portion providing the discharge port by the second pattern. In order that the cross-sectional shape of the discharge port may keep a square shape, it is preferable that the plated layer formed on the first pattern be formed so as not to go beyond the second pattern.

The fusible first resin and second resin may preferably be photosensitive resins, and more preferably be photosensitive resins of a positive type.

Further, the second pattern may preferably be of a forwardly tapered shape.

The plated layer may preferably be of a multi-layered construction, and the outermost layer of the plated layer may preferably be a water-repellent layer, and more preferably be nickel containing fluorine resin.

DESCRIPTION OF THE PREFERRED EMBODIMENTS

The present invention will hereinafter be described in detail with reference to the drawings. The present invention can be applied to all of liquid discharge heads having a flow path structure provided with a plurality of liquid chambers and through ports, and is not restricted by a driving method.

The liquid discharge head of the present invention will hereinafter be described in detail with reference to the drawings. The structure of the liquid discharge head of the present invention will first be described with reference to the drawings.

Figure 1:
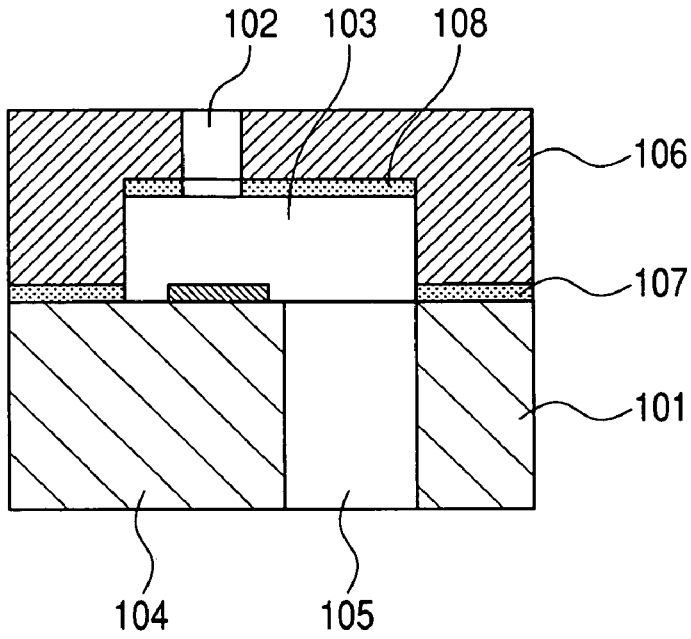
FIG. 1 shows an example of a liquid discharge head of a BJ type according to the present invention.

FIG. 1 is a typical cross-sectional view of a liquid discharge head of a bubble jet type utilizing heat energy, and this liquid discharge head has a flow path structure provided with a liquid chamber 103 and a through port 102 providing a liquid discharge port. In FIG. 1, liquid is supplied from an opening portion 105 extending through a substrate 101 to the liquid chamber 103, and the supplied liquid is heated and foamed by a heater 104 formed on the substrate 101 in the liquid chamber 103, and is discharged from the through port 102 providing the liquid discharge port by produced pressure.

The wall surface of the liquid chamber is covered with metal film 107 and metal film 106 formed on the substrate 101. Metal film forming the upper surface of the liquid chamber 103 are of a layered construction comprising metal film 108 and the metal film 106.

Figure 2:
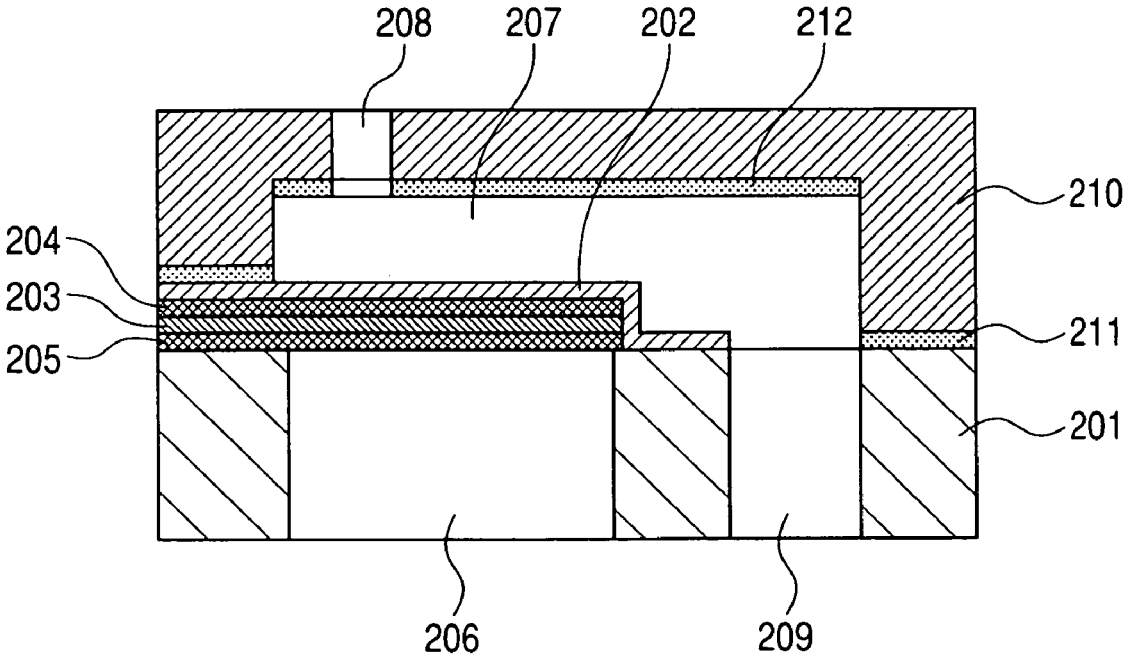
FIG. 2 shows an example of a liquid discharge head having a piezoelectric member thin film element according to the present invention as an actuator.
Figure 3A:
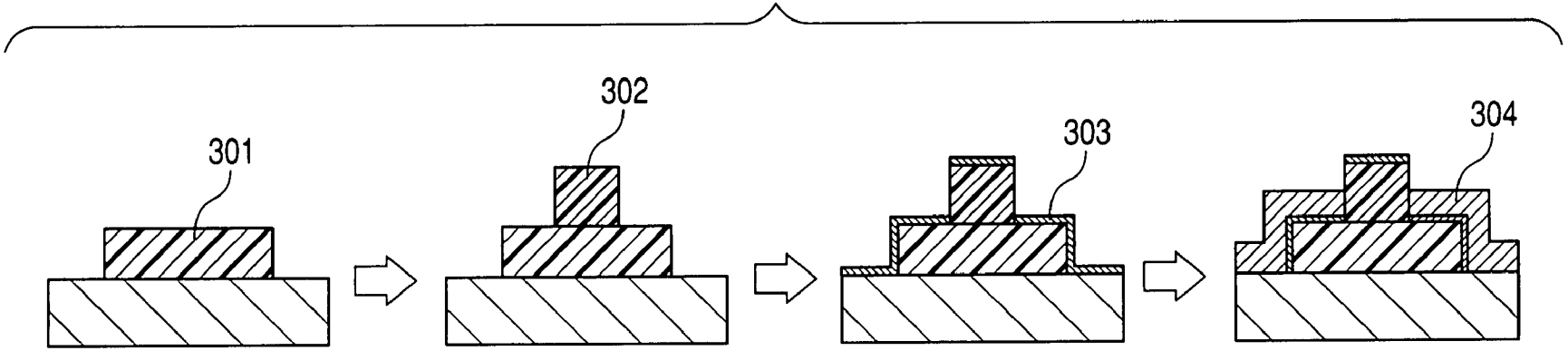
FIGS. 3A and 3B schematically illustrate liquid discharge heads according to the prior art.
Figure 3B:
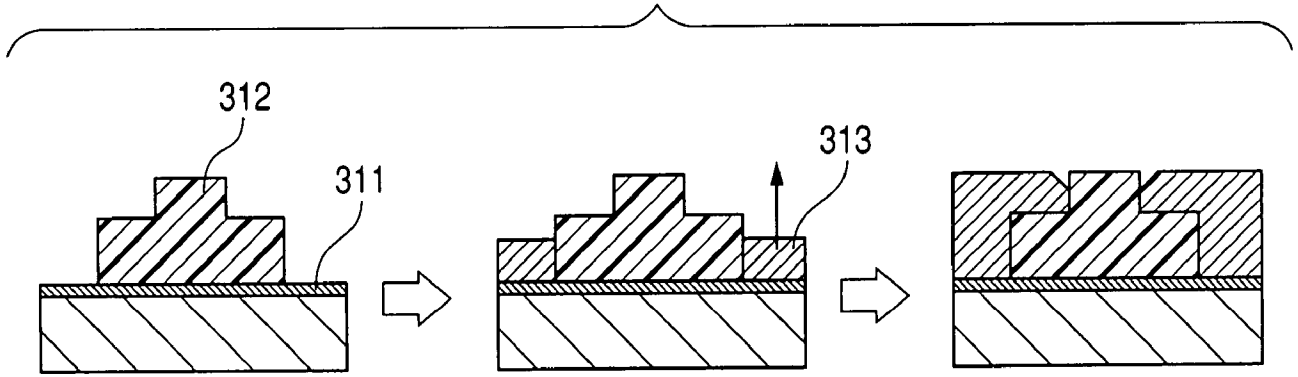

FIG. 2 is a typical cross-sectional view of a liquid discharge head using a piezoelectric element, and this liquid discharge head has an opening portion 206 extending through a substrate 201 and providing the back cavity of a piezoelectric element formed on the substrate 201, a liquid supply port 209 extending through the substrate and providing a supply port for the liquid, a vibrating plate 202 formed on the substrate 201 and having the opening portion 206 as the back cavity, piezoelectric member thin film 203, an upper electrode 204 and a lower electrode 205, and the liquid supplied from the liquid supply port to a liquid chamber 207 by pressure produced by the deformation of the vibrating plate formed on the piezoelectric member thin film is discharged from a discharge port 208.

The concept of a manufacturing method will now be described by the use of the liquid discharge head utilizing heat energy which is shown in FIG. 1. FIGS. 4A to 4F, 5A to 5D, 6A and 6B are typical process cross-sectional views of the liquid discharge head utilizing heat energy.

Each step will hereinafter be described with reference to the drawings.

(1) Insulating film 402*a* for insulating a heat generating element providing a heater and a substrate from each other is formed on the front side of the substrate 401, and protective film 402*b* for preventing the substrate except a predetermined portion thereof from being etched when an opening portion extending through the substrate 401 is formed is formed on the back side of the substrate 401. That portion of the protective film 402*b* formed on the back side which corresponds to the opening portion is removed (see FIG. 4A).

As the substrate 401, use can be made of a silicon substrate, a glass substrate, a plastic substrate or the like. Whichever substrate, if it has desired strength, may be used, but it is preferable to use a silicon substrate, from the viewpoints of the ease with which a driving circuit of high integration and high density by a fine working technique is formed, and the ease with which silicon is oxidized to thereby form insulating film.

When the substrate 401 is a silicon substrate, it is preferable because of the ease of fine working that the insulating film 402*a* and the insulating film 402*b* be insulating film of silicon such as silicon oxide ($SiO_2$) film, silicon nitride ($SiN_x$) film or silicon oxide nitride (SiON) film.

The opening portion extending through the substrate, in the case of a silicon substrate, can be formed by a method such as anisotropic etching using alkali etching liquid such as TMAH (tetramethyl ammonium hydride) or KOH (potassium hydroxide), dry etching such as RIE or Deep RIE (ICP), or sand blast, but because of the ease of fine working, it is preferable to use the anisotropic etching using alkali etching liquid or Deep RIE (ICP), and it is more preferable to use the anisotropic etching using the alkali etching liquid because the treatment of a number of substrates can be done at a time.

When the substrate 401 is to be etched by the use of the anisotropic etching using the alkali etching liquid or the Deep RIE (ICP), silicon insulating film such as silicon oxide ($SiO_2$) film, silicon nitride ($SiN_x$) film or oxide-nitride silicon(SiON) film is preferably used because it is resistant to the etching.

When silicon insulating film is used as the protective film 402*b*, that portion of the protective film 402*b* which corresponds to the opening portion can be removed by ordinary dry etching by the use of photolithography with a pattern comprising photoresist as a mask.

As the insulating film 402*a* and the protective film 402*b*, use may be made of layered film in which two or more kinds of film are layered, as in layered film of e.g. silicon oxide film and silicon nitride film, for the adjustment of film stress and improvement in close contacting property.

(2) Next, a heat generating resistive element is formed on the insulating film 402*a*. The heat generating resistive element can have its heater 403, electrode and wiring manufactured by the use of an ordinary semiconductor process.

The heat generating resistive element is formed by a wiring portion made of a metal (e.g. Al, Au, Ag, Cu or the like) which is a good electrical conductor being layered on heat-resistant resistive materials such as, for example, $HfB_2$, $ZrB_2$, $TaN_2$ and TaSi with an intermediate layer (e.g. Ti, Cr or the like) interposed therebetween so that the intermediate layer may be exposed, and the exposed portion provides the heater 403. Also, protective film or the like for preventing the electric corrosion and oxidation by the discharged liquid is formed on the heater and the electrode, as required. In the drawings, only a heat-resistant resistive material providing a part of the heater 403 is shown as the heater 403.

Figure 4A:
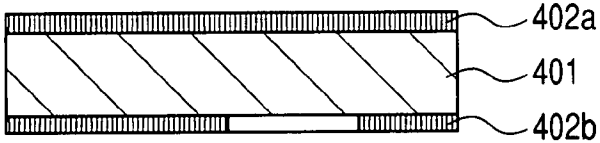
FIGS. 4A, 4B, 4C, 4D, 4E and 4F are process cross-sectional views typically showing a method of manufacturing the liquid discharge head of the BJ type according to the present invention.
Figure 4B:
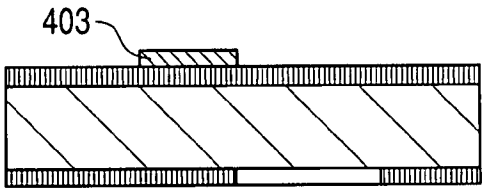
Figure 4C:
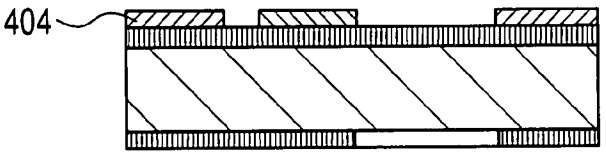

For example, the heat-resistant resistive material can be formed by forming film comprising $HfB_2$ on the insulating film 402*a* by the use of a sputtering method, and forming a desired pattern comprising photoresist on a mask by ordinary dry etching by the use of photolithography (see FIG. 4B).

(3) Next, an electrically conductive layer (first electrically conductive layer) 404 providing plating seed film is formed on the substrate 401. As the electrically conductive layer 404, use can be made of Pt, Au, Ag, Cu, Ni or the like. A low-resistance material is preferable as the electrically conductive layer 404, and it is preferable to use Pt, Au, Ag, Cu or the like.

In order to improve the close contacting property with the insulating film, it is also possible to make layered structure with Ti as a binder metal.

Since the wall surface of the liquid chamber is formed by plating, the electrically conductive layer 404 need not be formed in an area providing the interior of the liquid chamber. That area of the electrically conductive layer 404 which provides the interior of the liquid chamber can be formed by removing the electrically conductive layer 404 by ordinary dry etching by the use of photolithography with the desired pattern comprising photoresist as a mask (see FIG. 4C).

Usually, insulating film providing protective film is formed on the heater 403, but this is omitted in this description.

Since the electrically conductive layer 404 provides the plating seed film, it is preferable that a voltage be supplied from a portion of the electrically conductive layer 404, whereby the voltage be supplied to the entire plating seed layer and thus, it is preferable to make the electrically conductive layer 404 free of any discontinuous portion on the substrate 401.

(4) Next, resin film 405 fusible by a solvent for forming a first pattern 409 constituting the shape of the liquid chamber is formed on the substrate 401.

As methods of obtaining a desired pattern by the use of desired resin film, there are a printing method, photolithography, etc., but to obtain a minute shape, it is preferable to use photosensitive resin and use photolithography.

Figure 4D:
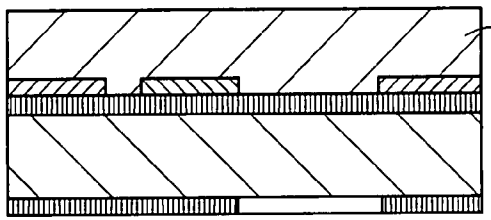
Figure 4E:
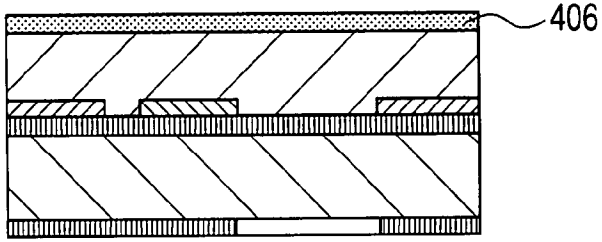

At the present step, the fusible resin 405 forming the first pattern which will provide the liquid chamber later by being moved is formed, for example, by being applied by the use of a spin applying method, and thereafter being dried (see FIG. 4D).

(5) An electrically conductive layer (second electrically conductive layer) 406 is formed on the fusible resin film 405. As the electrically conductive layer, use can be made of Pt, Au, Ag, Cu, Ni or the like. As the electrically conductive layer on the substrate, one having low resistance and resistant to plating liquid is preferable, and a material such as Pt, Au or Ag which is low in ionizing tendency is suitably used.

At this step, an electrically conductive layer in an area forming a second pattern may be removed in advance by a laser or the like. This facilitates the formation of a through port during the removal of the molding member at the subsequent step (see FIG. 4E).

Figure 4F:
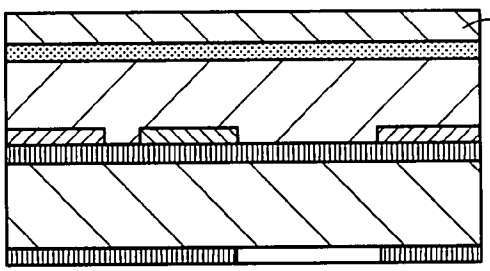

(6) Fusible resin 407 forming the second pattern providing the discharge port of the liquid chamber by being removed later is applied and dried by a method similar to that for the resin 405 (see FIG. 4F).

It is preferable that the discharge port of the liquid chamber have a tapered shape, and it is preferable to use positive type photosensitive resin.

(7) For patterning the electrically conductive layer on the first pattern, the fusible resin forming the second pattern is exposed and developed by the use of a mask so as to leave a portion providing the upper surface of the liquid chamber. The electrically conductive film 406 is removed with this resin pattern as a mask (see FIG. 5A).

When the electrically conductive film 406 is Pt, it can be etching-removed by the use of an ion mealing method, and when the electrically conductive film 406 is Au or Ag, it can be etching-removed by the use of the ion mealing method or a wet etching method.

(8) Next, in order to form a second pattern 408 providing a discharge port on the resin film 407 left on the electrically conductive layer 406, exposure is effected by the use of a mask.

Figure 5A:
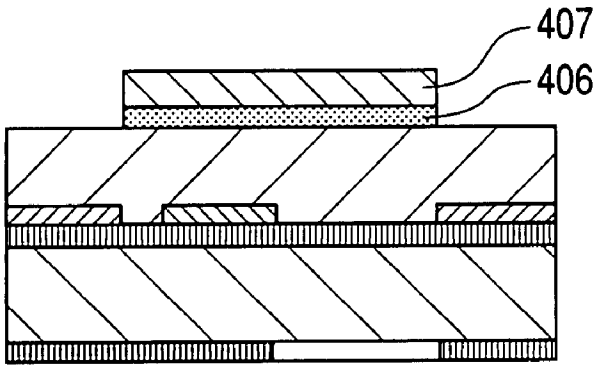
FIGS. 5A, 5B, 5C and 5D are process cross-sectional views typically showing the method of manufacturing the liquid discharge head of the BJ type according to the present invention.
Figure 5B:
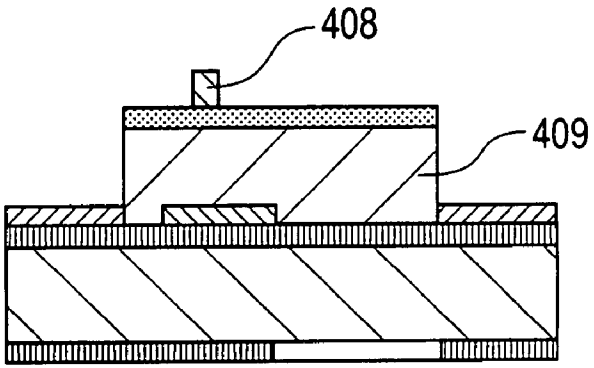

(9) Thereafter, the resin layer 405 is exposed, and then developed, to thereby form a first pattern 409 comprising the discharge port 408 and layered film of the resin layer 405 and electrically conductive layer 406 forming the liquid chamber, whereby there is formed a flow path pattern in which the liquid chamber and the discharge port are integrally formed (see FIG. 5B).

In order to efficiently convert the discharging pressure produced in the liquid chamber into the discharge of the liquid, it is preferable that the second pattern be of a forwardly tapered shape. That is, it is preferable that the area of the upper surface side of the second pattern 408 be made smaller than the area of that side of the second pattern 408 which is adjacent to the first pattern 409. This shape can be realized by deviating the focus when a projection aligner is used in exposure, and by widening the gap between a photomask and a substrate when a proximity aligner is used in exposure.

The forwardly tapered shape can also be realized by effecting overetching in development, or using a gradation mask as a photomask, or effecting exposure by a laser.

Figure 13:
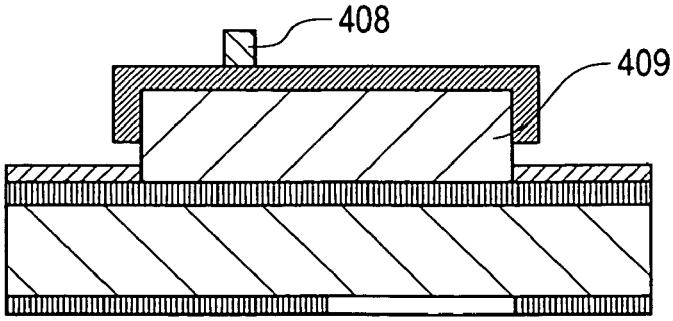
FIG. 13 is a cross-sectional view typically showing the liquid discharge head of the present invention.

It is preferable that the electrically conductive layer 406 on the first pattern 409 be smaller than the upper surface of the first pattern 409. If the electrically conductive layer 406 on the first pattern 409 is larger than the upper surface of the first pattern 409, the electrically conductive layer hangs down so as to cover the first pattern 409 (see FIG. 13), and the hanging-down portion may sometimes be wrinkled. If the electrically conductive layer 406 is smaller than the upper surface of the first pattern 409, it is advantageous in uniformly forming metal film by plating. Here, the upper surface of the first pattern refers to the surface area of the resin film 405 after the formation of the first pattern 409.

Figure 5C:
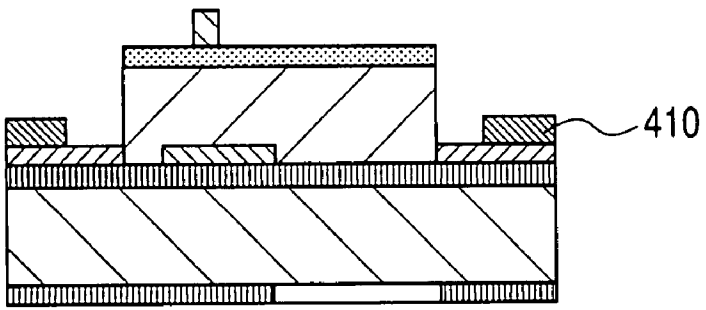

(10) A mask 410 comprising photoresist is formed by the use of photolithography so that only the area of the electrically conductive film 404 which forms the wall surface of the liquid chamber may be exposed (see FIG. 5C).

Figure 5D:
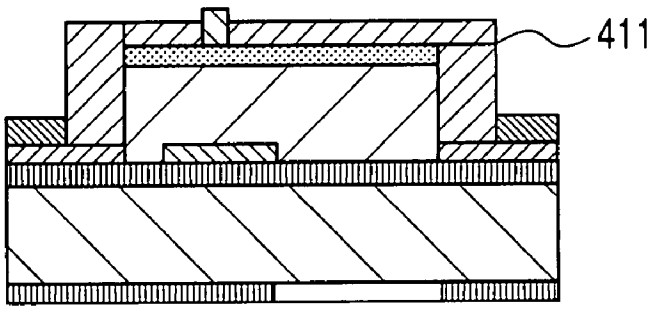
Figure 6A:
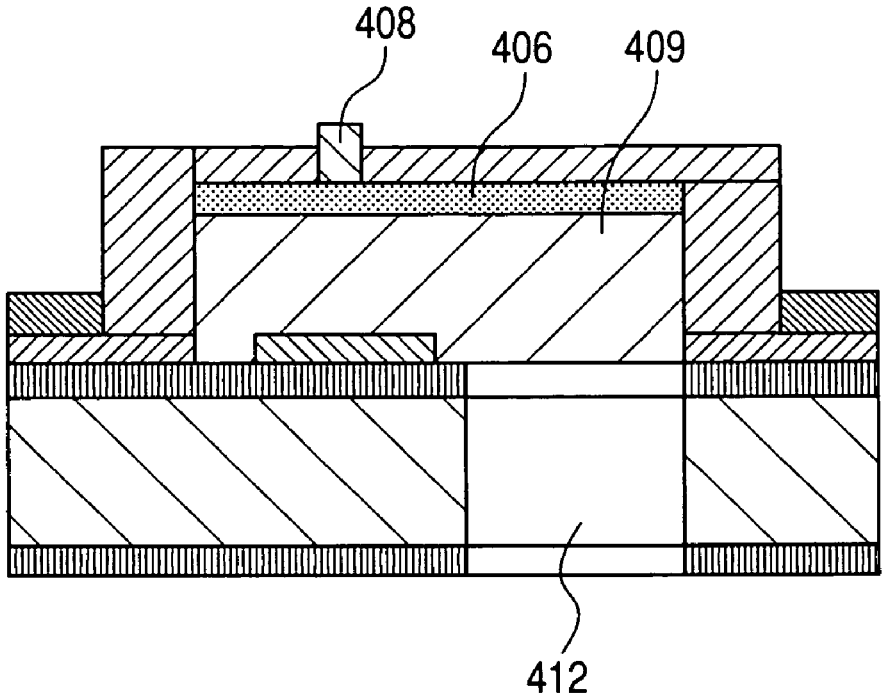
FIGS. 6A and 6B are process cross-sectional views typically showing the method of manufacturing the liquid discharge head of the BJ type according to the present invention.
Figure 6B:
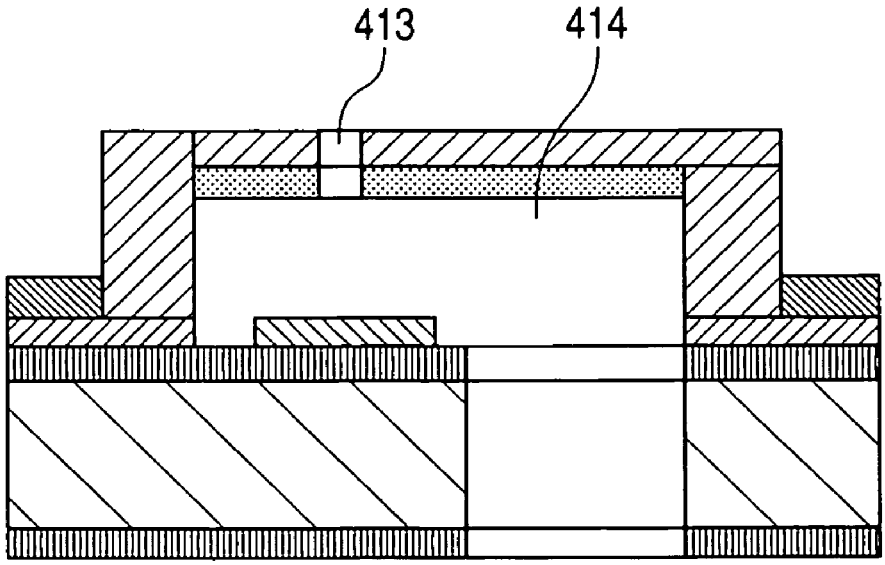

(11) By the plating process, metal film 411 providing the wall surface of the liquid chamber is formed with the electrically conductive film 404 as plating seed film so as to cover the liquid chamber and the through port (see FIG. 5D).

The kinds of plating include electrolytic plating and non-electrolytic plating, and these can be properly used at any suitable time. The electrolytic plating is advantageous in that the processing liquid is inexpensive and that the treatment of waste liquid is simple. The non-electrolytic plating is excellent in that throwing power of electrolytic color is good, that uniform film can be formed and that plating film is hard and has wear resistance.

As the kinds of plating, mention may be made of single-metal plating such as Cu, Ni, Cr, Zn, Ag or Au plating, alloy plating, compound plating which precipitates PTFE or the like, etc. From the viewpoints of chemical resistance, strength and cost, it is preferable to use Ni.

Also, if the liquid spreads around the through port, disturbance will occur to the discharge direction of the liquid and therefore, it is preferable that the surface of the plated layer be liquid-repellent. For this reason, it is preferable that at least the uppermost surface of the metal film 411 be subjected to compound plating which precipitates PTFE or the like, to thereby enhance liquid-repellency. It is also possible to add an additive and carry out the plating process to thereby control hardness and surface roughness.

When the metal film 411 is to be formed by the electrolytic plating method, the metal film 411 is formed on the wall surface of the first pattern 409 until the metal film 411 reaches the electrically conductive film 406 formed on the upper surface of the first pattern 409, and-when the metal film 411 reaches the electrically conductive film 406 formed on the upper surface of the first pattern 409, metal film 411 providing plated film is formed on the electrically conductive film 406 and the metal film 411 formed on the outer periphery thereof.

In contrast, when the non-electrolytic plating is effected, the metal film 411 has the nature that whether or not it reaches the upper surface of the first pattern, metal film is formed on the entire portion on which is formed a metal having autocatalytic action.

When metal film by plating is to be formed on the outer periphery of a flow path pattern, use can be made, for example, of (1) a method of simply forming metal film from an electrically conductive layer on a substrate by the use of the electrolytic plating method, or (2) a method of first forming metal film from the electrically conductive layer on the substrate by electrolytic plating, and forming the metal film to a suitable thickness, and thereafter changing over to non-electrolytic plating.

In the case of item (1), the process is very simple. In the case of item (2), the thickness of the metal film formed on the first pattern can be made uniform. Also, there is the merit that the metal film by the non-electrolytic plating is harder than the metal film by the electrolytic plating.

It is preferable that the metal film formed by plating do not cross over the upper surface of the second pattern 408. If the metal film by plating crosses over the upper surface of the second pattern 408, the corners of the cross-sectional shape of the through port will become rounded, and deposition accuracy will lower. In order to prevent this, the step of grinding or the like must be done. Here, the height of the upper surface of the second pattern refers to the minimum value of the distance from the area in which the surface when the application and drying of the fusible resin forming the second pattern has been done is left after patterning to the substrate.

(12) The substrate 401 is etching-removed by the utilization of anisotropic etching by alkali etching liquid or etching by the Deep RIE (ICP) method through the opening portion of the protective film 402*b* formed on the back side of the substrate. The insulating film 402*a* formed on the front side of the substrate performs the role of a layer stopping this etching, and stops the etching when it reaches the insulating film 402*a*. Thereafter, the insulating film 402*a* is removed by the use of a dry etching method or a wet etching method, whereby an opening portion 412 in which the resin film 405 fusible by a solvent is exposed is formed. In the case of a liquid discharge head utilizing heat energy, this opening portion 412 provides a supply port for the liquid to the liquid chamber (see FIG. 6A).

In order to protect the front side of the substrate from the anisotropic etching by the alkali etching liquid or the etching by the Deep PIE (ICP) method, resin removable afterwards is applied to the front side of the substrate, or the substrate is mounted on a jig capable of treating only the back side of the substrate (not shown).

(13) Lastly, the first pattern 409 and second pattern 408 comprising resin film fusible by a solvent are fused by the solvent and removed. Thereafter, the electrically conductive layer 406 exposed on the bottom surface of the opening portion after the second pattern 408 providing the liquid discharge port has been removed is removed by dry etching or wet etching to thereby form a discharge port 413 and a liquid chamber 414, thus completing a liquid discharge head (see FIG. 6B).

Also, in the case of a liquid discharge head having as an actuator a piezoelectric member thin film element having a flow path structure provided with the liquid chamber and through port of FIG. 2, of course, the method of manufacturing a flow path structure provided with a liquid chamber and a through port is similar to that described above with the exception that not a heater but a piezoelectric member thin film element is formed.

Of course, the liquid discharge heat of the present invention can assume one of a form in which a plurality of pressure producing chambers are connected to an ink reservoir (not shown) through a communication hole and a form in which there are provided a plurality of heads in each of which a pressure producing chamber is connected to an ink reservoir through a communication hole.

Some embodiments of the present invention will now be described.

<Embodiment 1>

FIGS. 7A to 7F, 8A to 8D and 9 are typical process cross-sectional views showing a manufacturing method according to Embodiment 1. As a substrate, use was made of a silicon substrate 501 of 6 inches having a surface azimuth of (110) and a thickness of 300 μm.

Oxidated ($SiO_2$) film 502 having a thickness of 600 nm was formed on the front and back sides of the silicon substrate 501 by a thermal oxidation method.

A mask comprising photoresist was formed by photolithography, and the oxidated film 502 in an area forming the opening in the back side of the silicon substrate 501 was removed by the use of this mask. Next, the oxidated film 502 on that portion of the oxidated film formed on the front side of the silicon substrate 501 which corresponds to the area forming the opening in the back side was removed, and polysilicon (Poly-Si) having a thickness of 600 nm was formed on the front side of the silicon substrate 501 in order to fill the opening portion of the oxidated film 502. In order to bring about a state in which only the opening portion is filled with the polysilicon, the polysilicon on the oxidated film 502 is removed by the use of a usually used chemico-mechanical grinding method, and a sacrifice layer 513 formed of the polysilicon is formed in the oxidated film 502.

Figure 7A:
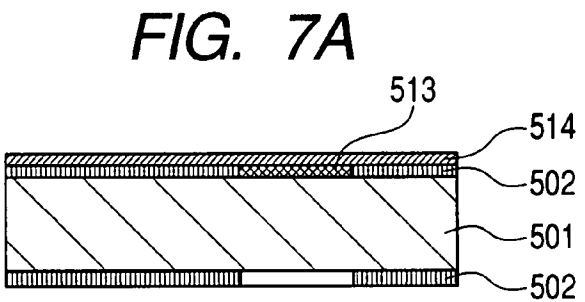
FIGS. 7A, 7B, 7C, 7D, 7E and 7F are process cross-sectional views typically showing a method of manufacturing the liquid discharge head of the present invention.

Further, oxidated ($SiO_2$) film having a thickness of 400 nm providing an etching stop layer 514 was formed on the front side of the silicon substrate 501 by a CVD method (see FIG. 7A).

Figure 7B:
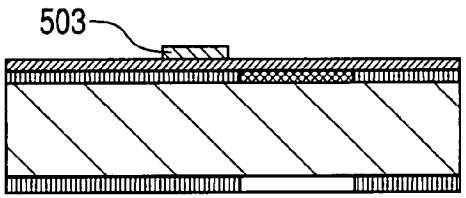

Next, a heat-resistant resistive material comprising $HfB_2$, an intermediate layer formed of Ti and a wiring portion formed of Al were layered and formed so that the intermediate layer might be exposed to thereby prepare a heater 503 (see FIG. 7B). The heater and other driving circuit can be prepared by an ordinary semiconductor technique and therefore the manufacturing method therefor need not be described in detail.

Figure 7C:
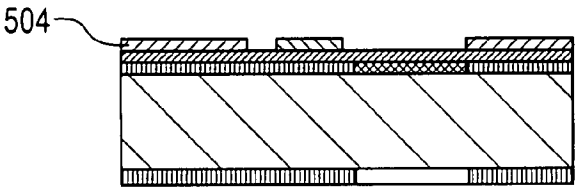
Figure 7D:
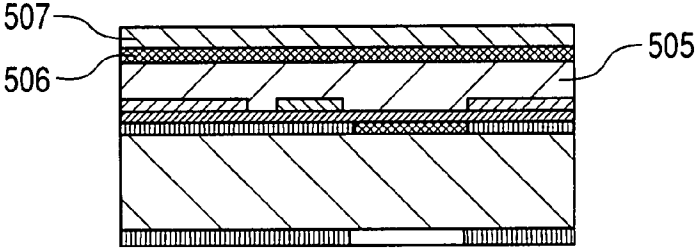
Figure 7E:
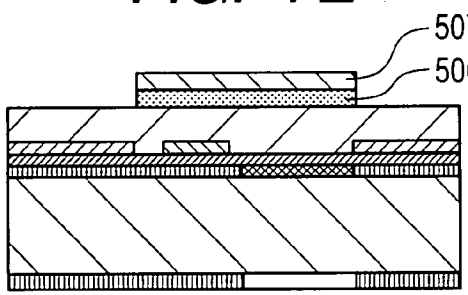
Figure 7F:
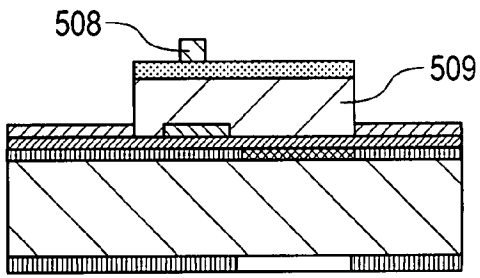

Ti/Au film having a thickness of 5 nm/150 nm was formed on the substrate by sputtering, whereafter an electrically conductive layer 504 providing a plating seed layer was formed by the use of an etching method using a mask comprising photoresist formed by the use of photolithography (see FIG. 7C).

Here, Ti is a binder layer for improving the close contact between the substrate and Au.

The electrically conductive layer 504 comprising Ti/Au was etching-removed by the use of a known iodine or potassium iodide etching solution, whereafter Ti was etching-removed by the use of a hydrofluoric acid etching solution.

Next, PMER LA-900PM (trade name) produced by Tokyo Oka Kogyo was applied onto the substrate as a resin layer 505 comprising fusible resin providing a first pattern 509 by a spinner so as to have a thickness of 15 μm, and thereafter was dried. Au providing an electrically conductive layer 506 on the upper surface of the first pattern was formed as film having a thickness of 50 nm on the resin layer 505 by sputtering. Then, PMER LA-900PM (trade name) produced by Tokyo Oka Kogyo was applied as a resin layer 507 comprising fusible resin providing a second pattern by a spinner so as to have a thickness of 20 μm, and thereafter was dried (see FIG. 7D).

As the fusible resin used in the present invention, photosensitive resin is utilized, and if photolithography art is utilized, a minute pattern can be formed with good accuracy, and this is preferable. Also, it is necessary that the thickness of the first pattern 505, i.e., the height of the liquid chamber, be several tens of μm or greater in order to decrease flow path resistance, that the first pattern be removable afterwards by an alkali solution or an organic solution, and that the first pattern be resistant to plating liquid. Further, in ink jet, it is preferable that the through port have a forward tapered shape. The forward tapered shape is easier to realize by positive type photosensitive resin and therefore, it is preferable to use plating resist for positive type thick film, and use can be made of THB series produced by JSR or PMER series produced by Tokyo Oka Kogyo.

Next, the resin layer 507 was exposed and developed by the use of a mask, and the resin layer 507 was subjected to patterning. With this pattern as a mask, the electrically conductive layer 506 comprising Au was removed under the same condition as Ti/Au by the wet etching method (see FIG. 7E).

Next, exposure was effected by a photomask forming the second pattern 508 providing the through port, and then exposure was effected by a photomask forming the first pattern 509 providing the liquid chamber. The exposure was effected by MPA600 Type Exposing Apparatus produced by CANON. After such dual exposure was effected, development was effected to thereby prepare a molding member. During the exposure of the second pattern 508, the focus was deviated by 30 μm so as to be kept away from the front side of the substrate. The second pattern 508 was such that the radius of the upper surface side thereof was 8 μm and the radius of the surface side thereof adjacent to the first pattern was 25 μm (see FIG. 7F).

Figure 8A:
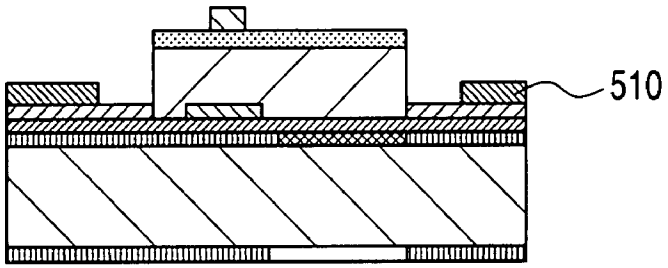
FIGS. 8A, 8B, 8C and 8D are process cross-sectional views typically showing the method of manufacturing the liquid discharge head of the present invention.
Figure 8B:
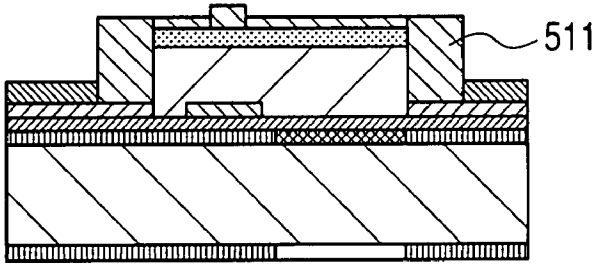

A mask 510 comprising photoresist was formed on an area on the electrically conductive layer 506 providing the plating seed layer excluding the wall surface area of the liquid chamber by the use of photolithography (see FIG. 8A). The mask 510 can also be formed by the aforedescribed exposure when the first pattern 509 is formed. In this case, as shown in FIGS. 11A to 11D, masks by photoresist are formed on the opposite sides of a plating forming area and therefore, grow on the area sandwiched by the resin 509 until a plated layer reaches the electrically conductive layer 506 on the first pattern (see the right plated layer in FIGS. 11A to 11D), and when the plated layer 511 reaches the electrically conductive layer 506 formed on the first pattern, the plated layer 511 and the electrically conductive layer 506 conduct with each other, and plating is started by the surface of the plated layer 511 and the surface of the electrically conductive layer 506 and therefore, a liquid chamber completed in shape is formed.

As an ante-plating process, the liquid chamber was immersed in dilute sulfuric acid of 5%. It was put into sulphamine acid Ni electroforming bath of desired density and temperature and was subjected to an electroplating process. The electroplating process was stopped when the maximum thickness of the metal film became 30 μm. Thereafter, sulphamine acid Ni, Ni chloride, boric acid, fine particles (particle diameter of 0.3 μm) of PTFE, etc. were mixed together at a desired ratio, and the mixture was put into an electroforming bath of desired density and temperature and was subjected to an electroplating process. The electroplating was stopped when an Ni-PTFE layer became 2 μm, and washing and drying were effected (see FIG. 8B).

Figure 8C:
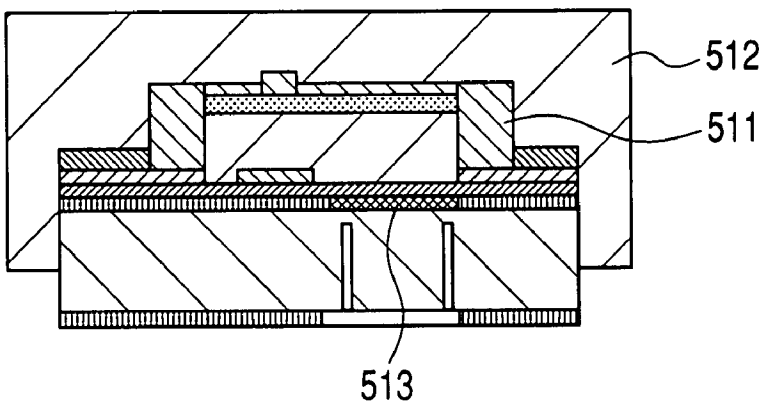

Surface protecting film 512 for protecting that surface of the silicon substrate 501 on which the metal film is formed from alkali etching liquid was formed by the use of OBC (trade name) which is cyclized rubber resin produced by Tokyo Oka Kogyo, whereafter a hole having a diameter of 20 μm and a depth of 250 μm was formed near the insulating film 502 inside the opening portion of the insulating film 502 on the back side of the substrate by laser working (see FIG. 8C). Thereby, an oblique surface (111) produced during anisotropic etching is suppressed. The diameter should preferably be 15 μm to 30 μm.

Figure 8D:
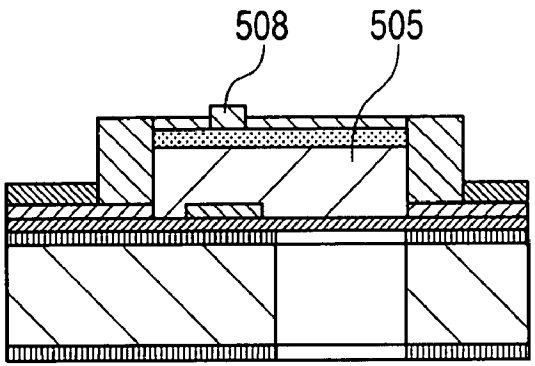
Figure 9:
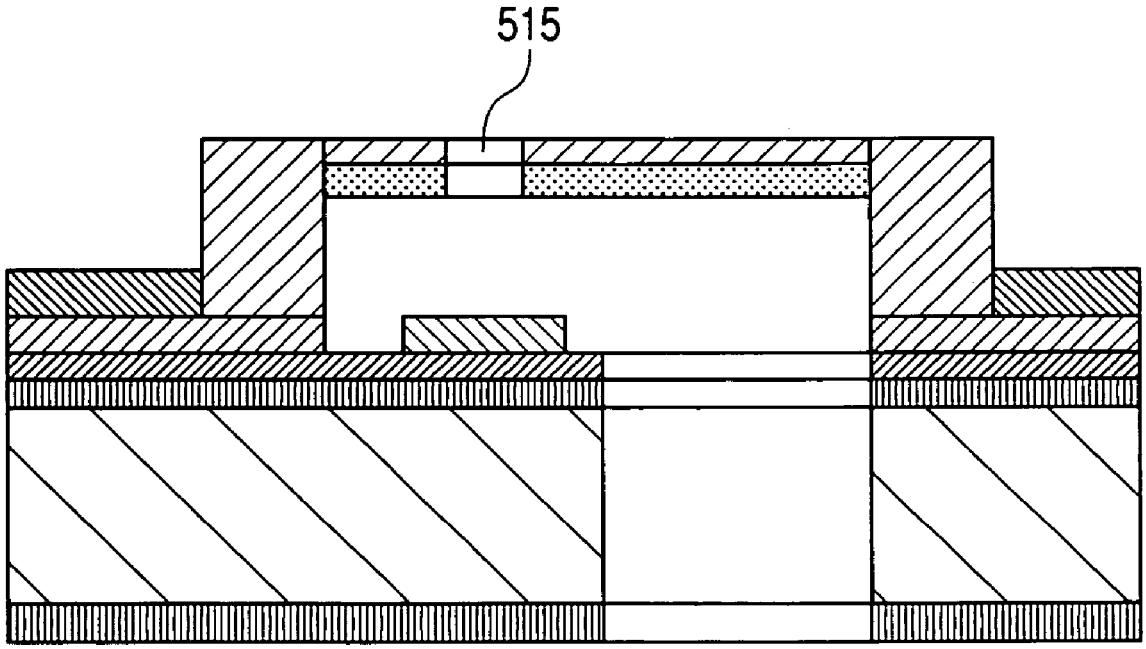
FIG. 9 is a process cross-sectional view typically showing the method of manufacturing the liquid discharge head of the present invention.

The substrate was anisotropically etched by the use of etching liquid of temperature 80° C and TMAH 22 wt % to thereby remove the silicon substrate (see FIG. 8D). The etching was stopped on an etching stop layer 514. After the termination of the etching, the $SiO_2$ layer which is the left etching stop layer was removed by wet etching using buffered hydrofluoric acid.

When the substrate is anisotropically etched and the etching reaches a sacrifice layer 513 comprising polysilicon, the sacrifice layer is quickly etching-removed because the etching speed of polysilicon is higher than that of the crystal silicon of the substrate. Even when there is unevenness in the thickness of the substrate, if the sacrifice layer 513 is exposed to the etching liquid, it is quickly etching-removed and therefore, a supply port can be formed with good accuracy. While in the present embodiment, polysilicon was used as the material of the sacrifice layer 513, use can be made of any material such as amorphous silicon or aluminum (Al) which is higher in etching speed to wet etching liquid than crystal silicon.

Thereafter, OBC was removed by xylene. Lastly, the resin 505 and the resin 508 were removed by the use of a direct pass type washing apparatus (produced by Arakawa Kagaku Kogyo Co., Ltd.) (see FIG. 9). At this time, Pine Alpha ST-380 (produced by Arakawa Kagaku Kogyo Co., Ltd.) was used as a solvent. The processing temperature was 80° C. and the processing time was 20 minutes.

In the completed head, the diameter of a discharge port 515 was 10.5 μm on the average, and there was a distribution of 1.9 μm. The liquid repellency of the vicinity of the discharge port was 110° in terms of the contact angle of water. When discharge was effected, no deformation was seen in the discharge-port portion (through port portion). Further, the cross-sectional shape of the discharge port was a square shape, and when the distance from the discharge port to the object of discharge was 1.5 mm, deposition accuracy was within ±3 μm and discharge accuracy was good.

<Embodiment 2>

A method of manufacturing a liquid discharge head using the piezoelectric element of FIG. 2 will now be described with reference to the typical process cross-sectional views of FIGS. 10A to 10D.

As a substrate, use was made of a silicon substrate 601 of 6 inches having a surface azimuth of (110) and a thickness of 300 μm.

Silicon oxide ($SiO_2$) film 602 having a thickness of 600 nm was formed on the front and back sides of the silicon substrate 601 by a thermal oxidation method. A mask comprising photoresist was formed by photolithography, and the oxide film 602 on an area forming an opening in the back side of the silicon substrate 601 was removed by the use of this mask (see FIG. 10A).

PT (lower electrode)/PZT (piezoelectric member thin film)/Pt (upper electrode) providing a piezoelectric element portion 604 was formed as film by sputtering. The Pt film as the lower electrode had a thickness of 150 nm, the PZT film as the piezoelectric member thin film had a thickness of 2 μm, and the Pt film as the upper electrode had a thickness of 150 nm. Further, SiN as a vibrating plate 605 was formed as film having a thickness of 2 μm on the piezoelectric element portion by the CVD method and was subjected to patterning to thereby form a piezoelectric member thin film element (see FIG. 10B).

Figure 10A:
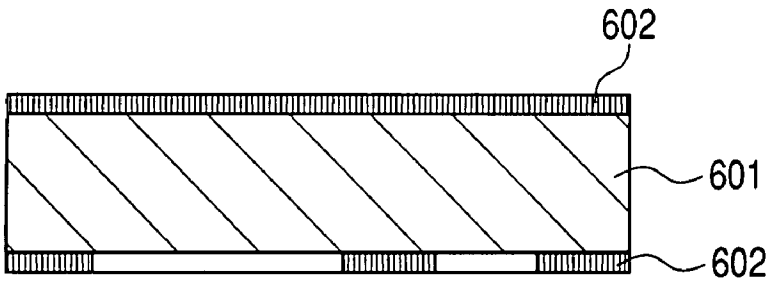
FIGS. 10A, 10B, 10C and 10D are process cross-sectional views typically showing a method of manufacturing the liquid discharge head of the present invention.
Figure 10B:
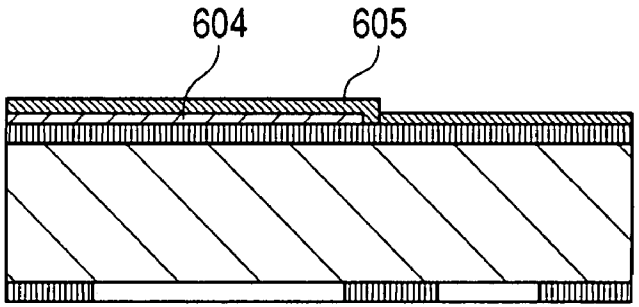
Figure 10C:
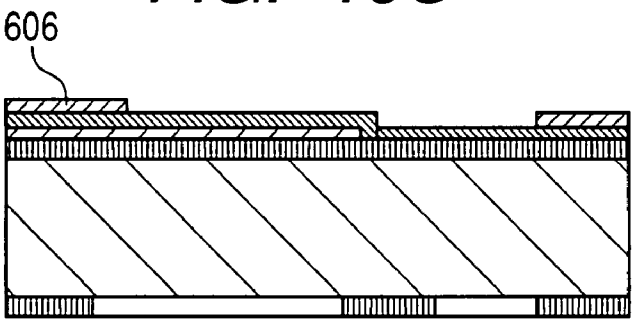
Figure 10D:
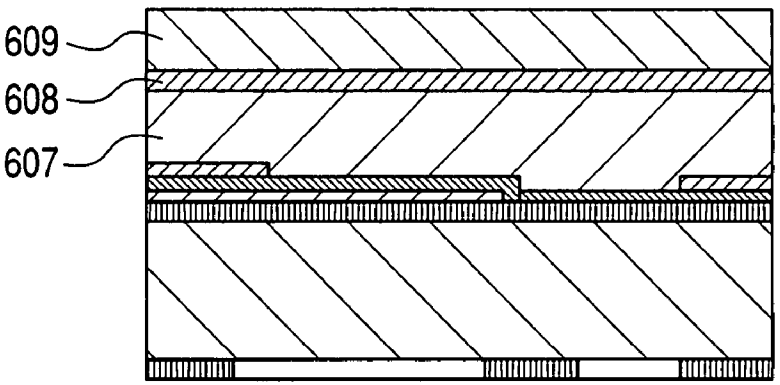

Ti/Au providing an electrically conductive layer 606 was formed as film having a thickness of 5 nm/150 nm on the silicon substrate 601 by sputtering, whereafter patterning was effected by a method similar to that in Embodiment 1 (see FIG. 10C).

Here, Ti is a binder layer formed to improve the close contact between the substrate and Au.

Next, PMER HM-3000PM (trade name) produced by Tokyo Oka Kogyo was applied onto the substrate as a resin layer 607 formed of fusible resin providing a first pattern by a spinner so as to have a thickness of 60 μm, and thereafter was dried. On the resin layer 607, Au was formed as film having a thickness of 50 nm providing an electrically conductive layer 608 on the upper surface of the first pattern by sputtering. Then, PMER HM-3000PM (trade name) produced by Tokyo Oka Kogyo was applied as a resin layer 609 formed of fusible resin providing a second pattern by a spinner so as to have a thickness of 25 μm, and thereafter was dried (see FIG. 10D).

Next, the resin layer 609 was exposed and developed by the use of a mask, and the resin layer 609 was subjected to patterning. Next, with this pattern as a mask, the electrically conductive layer 608 comprising Au was removed under the same condition as Ti/Au by the wet etching method (see FIG. 11A). Next, exposure was effected by a photomask forming a second pattern 611 providing a through port, and subsequently exposure was effected by a photomask forming a first pattern 610 providing a liquid chamber. The exposure was effected by MPA600 type exposing apparatus produced by CANON. After such dual exposure was effected, development was effected to thereby prepare a molding member.

Figure 11A:
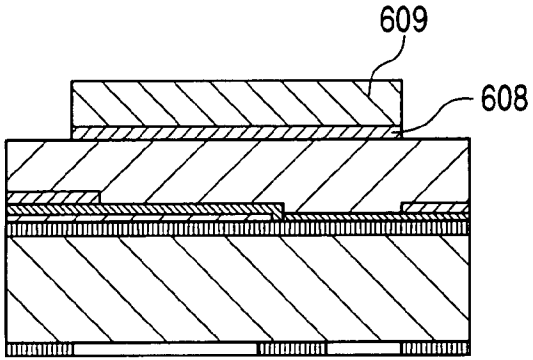
FIGS. 11A, 11B, 11C and 11D are process cross-sectional views typically showing a method of manufacturing the liquid discharge head of the present invention.
Figure 11B:
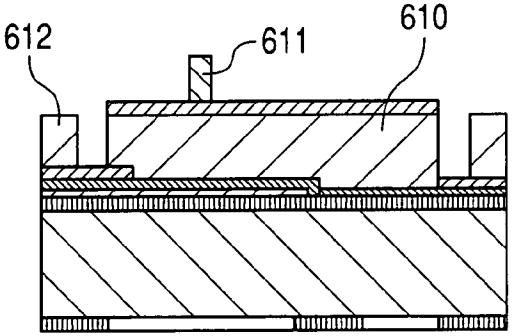
Figure 11C:
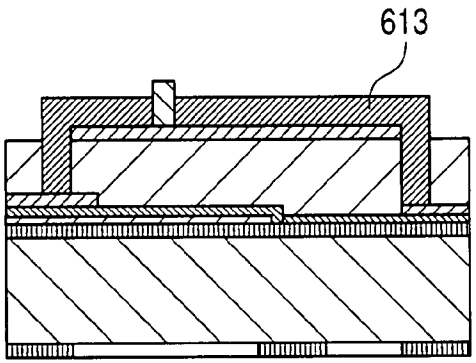
Figure 11D:
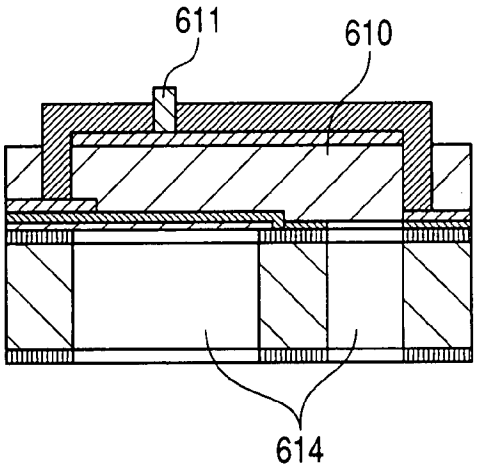

A plurality of liquid discharge heads are to be formed on the silicon substrate 601 and therefore, in order to prevent a plated layer from growing on a portion providing an after separating area around the liquid discharge ports, a mask 612 comprising photoresist was formed on an area on the electrically conductive layer 606 providing a plating seed layer, excluding the wall surface area of the liquid chamber by the use of photolithography (see FIG. 11B). During the exposure of the second pattern 611, the second pattern 611 was exposed with the focus deviated by 60 μm so as to be kept away from the front side of the substrate. The second pattern 611 was such that the radius of the upper surface side thereof was 5 μm and the radius of the first pattern surface side was 30 μm.

As the ante-plating process, it was immersed in dilute sulfuric acid of 5%. It was put into a sulphamine acid Ni electroforming bath of desired density and temperature and subjected to an electroplating process. The electroplating process was stopped when the maximum thickness of metal film 613 became 80 μm. Thereafter, sulphamine acid Ni, Ni chloride, boric acid, fine particles (particle diameter 0.3 μm) of PTFE, etc. were mixed together at a desired ratio, and the mixture was put into an electroforming bath of desired density and temperature to thereby carry out the electroplating process. The electroplating was stopped when the Ni-PTFE layer reached 2 μm, and washing and drying were effected (see FIG. 11C).

In order to protect that side of the silicon substrate 601 on which the metal film was formed from being etched by Deep RIE, OFPR-800 (trade name) produced by Tokyo Oka Kogyo was formed to a thickness of 10 μm on the front side of the silicon substrate 601 (not shown). Thereafter, Deep RIE was effected to thereby form an opening 614 extending through the silicon substrate 601.

Figure 12A:
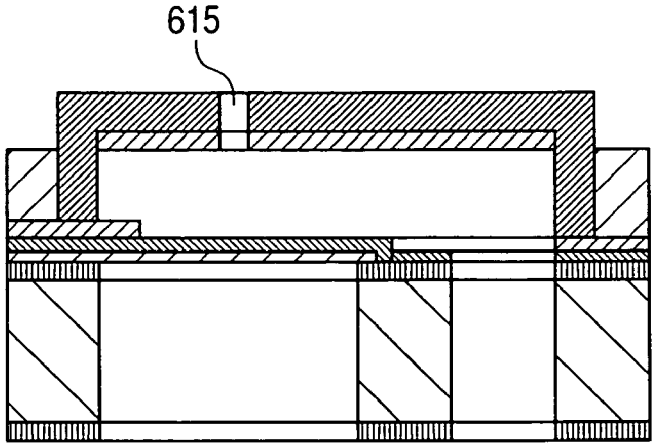
FIGS. 12A and 12B are process cross-sectional views typically showing a method of manufacturing the liquid discharge head of the present invention.

Thereafter, $SiO_2$ layer which is an etching stop layer was removed by wet etching using buffered hydrofluoric acid for semiconductor. Thereafter, OFPR-800 was removed by peeling liquid (see FIG. 11D). Lastly, the molding member 610, 611 was removed by the use of Direct Pass (produced by Arakawa Kagaku Kogyo). At this time, Pine Alpha ST-380 (produced by Arakawa Kagaku Kogyo Co., Ltd.) was used as a solvent (see FIG. 12A). The processing temperature was 80° C., and the processing time was 2 hours.

In the completed head, the diameter of a discharge port 615 was 10 μm on the average, and there was a distribution of 2 μm. The liquid repellency of the vicinity of the discharge port was 110° in terms of the contact angle of water. When discharge was effected, no deformation was seen in the discharge port portion (through port portion). Further, the cross-sectional shape of the discharge port was a square shape, and when the distance from the discharge port to the object of discharge was 1.5 mm, deposition accuracy was within ±3 μm and discharge accuracy was good.

<Embodiment 3>

Manufacture was carried out in a manner similar to that in Embodiment 1 with the exception that the electroplating process of Ni was stopped at a thickness of 15.5 μm, whereafter non-electrolytic Ni—B plating was effected by 7.5 μm.

In the completed head, the diameter of the discharge port thereof was 16.5 μm on the average and there was a distribution of 1.0 μm. As compared with Embodiment 1, the distribution was improved. The liquid repellency of the vicinity of the discharge port was 110° in terms of the contact angle of water. When discharge was effected, no deformation was seen in the discharge port portion (through port portion). Further, the cross-sectional shape of the discharge port was a square shape, and when the distance from the discharge port to the object of discharge was 1.5 mm, deposition accuracy was within ±3 μm and discharge accuracy was good.

<Embodiment 4>

Figure 12B:
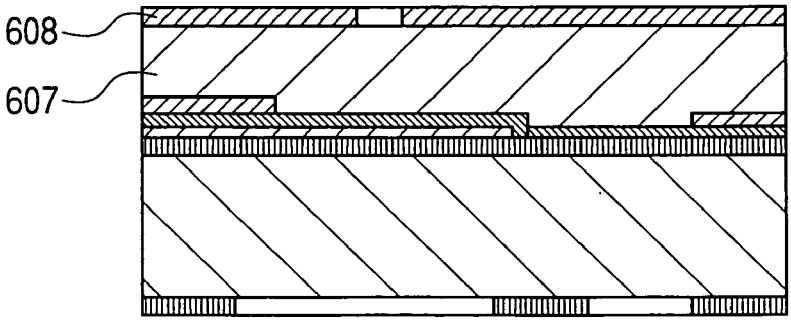

Manufacture was carried out in a manner similar to that in Embodiment 2 with the exception that on the resin layer 607, Au providing the electrically conductive layer 608 on the upper surface of the first pattern was formed as film having a thickness of 50 nm by sputtering, whereafter the electrically conductive layer on the second pattern area of the electrically conductive layer 608 was removed by laser working (see FIG. 12B). In the removal of the molding member using a direct pass type washing apparatus (produced by Arakawa Kagaku Kogyo Co., Ltd.), the time could be shortened to one hour.

The characteristic of the completed head did not differ from that of Embodiment 1.

This application claims priority from Japanese Patent Application No. 2004-231533 filed on Aug. 6, 2004, which is hereby incorporated by reference herein.

What is claimed is:

1. A method of manufacturing a liquid discharge head provided with a liquid flow path communicating with a liquid discharge port on a substrate, comprising:

a step of forming a first electrically conductive layer on the substrate;

a step of forming a molding member into a pattern shape of the flow path on the substrate;

a step of forming a second electrically conductive layer on the molding member so as not to contact the first electrically conductive layer;

a step of forming a metal film by a plating process around the molding member by utilization of the first electrically conductive layer and the second electrically conductive layer; and a step of removing the molding member and forming the flow path, wherein the molding member is formed of a photosensitive resin.

2. A method according to claim 1, wherein an area of the second electrically conductive layer is equal to or smaller than an area of an upper surface of the molding member.

3. A method according to claim 1, wherein before the plating process is carried out, a second molding member is formed into a pattern shape of the discharge port on the molding member.

4. A method according to claim 3, wherein a height from an uppermost surface of the metal film to an upper surface of the substrate is less than a height of the second molding member.

5. A method according to claim 3, wherein the second molding member is smaller in a cross-sectional area of an upper surface thereof than in a cross-sectional area of a substrate side thereof.

6. A method according to claim 1, wherein the metal film is of a multi-layered construction.

7. A method according to claim 6, wherein an uppermost layer of the metal film of the multi-layered construction is a liquid-repellent layer.

8. A method according to claim 7, wherein the liquid-repellent layer is nickel containing fluorine resin.

9. A method according to claim 1, wherein the photosensitive resin is of a positive type.

10. A method according to claim 1, further comprising a step of forming in the substrate a liquid supply port communicating with the flow path.

11. A method of manufacturing a liquid discharge head provided with a liquid flow path communicating with a liquid discharge port on a substrate, comprising:

a step of forming a first electrically conductive layer on the substrate;

a step of forming a molding member into a pattern shape of the flow path on the substrate;

a step of forming a second electrically conductive layer on the molding member so as not to contact the first electrically conductive layer;

a step of forming a metal film by a plating process around the molding member by utilization of the first electrically conductive layer and the second electrically conductive layer;

a step of removing the molding member and forming the flow path; and a step of removing a central portion of the substrate from a back side of the substrate between said step of forming the metal film around the molding member and said step of removing the molding member and forming the flow path.

12. A method according to claim 11, wherein said step of removing the central portion of the substrate is executed by crystal axis anisotropic etching.

* * * * *